US009644327B2

(12) United States Patent
Ejtaszewski et al.

(10) Patent No.: US 9,644,327 B2
(45) Date of Patent: May 9, 2017

(54) MAT FOR A HYBRID TURF

(71) Applicant: DYWILAN S.A., Lodz (PL)

(72) Inventors: Jacek Ejtaszewski, Lodz (PL); Marek Dabioch, Rzgow (PL); Piotr Jakubiak, Lodz (PL)

(73) Assignee: DYWILAN S.A., Lodz (PL)

( * ) Notice: Subject to any disclaimer, the term of this patent is extended or adjusted under 35 U.S.C. 154(b) by 374 days.

(21) Appl. No.: 13/966,435

(22) Filed: Aug. 14, 2013

(65) Prior Publication Data

US 2014/0050866 A1 Feb. 20, 2014

(30) Foreign Application Priority Data

Aug. 14, 2012 (PL) ..... 400399
Jul. 23, 2013 (EP) ..... 13177571

(51) Int. Cl.
*E01C 13/08* (2006.01)
*D03D 27/10* (2006.01)
*D06N 7/00* (2006.01)

(52) U.S. Cl.
CPC ..... *E01C 13/08* (2013.01); *D03D 27/10* (2013.01); *D06N 7/0065* (2013.01); *D06N 7/0068* (2013.01); *D06N 7/0071* (2013.01); *D06N 7/0073* (2013.01); *D06N 2201/02* (2013.01); *D06N 2201/0254* (2013.01); *D06N 2203/041* (2013.01); *D10B 2505/202* (2013.01); *E01C 2013/086* (2013.01)

(58) Field of Classification Search
CPC ..... D03D 27/00; D03D 27/06; D03D 27/10; D03D 27/12; D03D 27/16; E01C 13/08; E01C 2013/086; D06N 7/0068; D06N 7/0071; D06N 7/0073; D06N 2201/0254; D06N 2203/041; D10B 2505/202; Y10S 273/13
USPC ..... 428/93, 89, 97, 95, 17
See application file for complete search history.

(56) References Cited

U.S. PATENT DOCUMENTS 5,489,317 A * 2/1996 Bergevin ..... A63C 19/04 47/1.01 R
5,850,708 A * 12/1998 Bergevin ..... A63C 19/04 428/17

(Continued)

FOREIGN PATENT DOCUMENTS

EP 2142691 1/2010
WO WO 9400639 A1 * 1/1994 ..... A63C 19/04

(Continued)

*Primary Examiner* — Cheryl Juska
(74) *Attorney, Agent, or Firm* — Mark M. Friedman

(57) ABSTRACT

A mat for a hybrid sport or decorative turf, having a form of a woven fabric, with a single-sided cover pile made of olefin synthetic yarns such as polyethylene and/or polypropylene and/or polyester, according to a 3/8W or 5/12W or 7/16W weave structure, comprising pile burls interlaced with weft, wherein the ends of the burls form synthetic grass blades. The mat has from 5000 to 20000 pile burls per $m^2$, a warp density from 54 to 72 ends/10 cm, a weft density from 30 to 80 ends/10 cm and a pile height from 20 to 140 mm, wherein each pile burl (3) is interlaced at least two times over three weft fibers (5), and wherein the total surface mass of the mat is from 753 to 2105 $g/m^2$.

8 Claims, 2 Drawing Sheets

(56) References Cited

U.S. PATENT DOCUMENTS 6,094,860 A * 8/2000 Motz ..... E01C 13/083 405/302.7
6,242,062 B1 * 6/2001 de Vries ..... E01C 13/08 139/391
6,247,267 B1 * 6/2001 Motz ..... E01C 13/083 428/17
6,372,310 B2 * 4/2002 de Vries ..... 139/391
7,992,595 B2 * 8/2011 Debaes ..... D03D 27/10 139/102
8,557,363 B2 * 10/2013 Van Balen ..... E01C 13/08 139/2
2001/0007700 A1 * 7/2001 de Vries ..... E01C 13/08 428/17
2006/0204710 A1 * 9/2006 De Vries ..... E01C 13/08 428/89
2007/0237921 A1 10/2007 Knapp
2007/0248773 A1 10/2007 Nusca et al.
2008/0292819 A1 * 11/2008 Weghuis ..... E01C 13/08 428/17
2009/0162578 A1 * 6/2009 Van Balen ..... E01C 13/08 428/17
2009/0317569 A1 * 12/2009 Debaes ..... A41G 1/009 428/17
2010/0092701 A1 * 4/2010 Debaes ..... D03D 27/10 428/17
2010/0092702 A1 * 4/2010 Debaes ..... D03D 27/10 428/17
2010/0101678 A1 * 4/2010 Knapp ..... D03D 27/00 139/11
2010/0298073 A1 * 11/2010 De Vries ..... D05C 17/026 473/415
2012/0279125 A1 * 11/2012 Nusca ..... E01C 13/08 47/66.7
2014/0250780 A1 * 9/2014 Lee ..... D04B 21/10 47/56
2015/0033626 A1 * 2/2015 Sutherland ..... E01C 13/083 47/1.01 F
2015/0047259 A1 * 2/2015 Sarris ..... E01C 13/083 47/1.01 F
2015/0252537 A1 * 9/2015 Volterrani ..... E01C 13/08 47/1.01 F

FOREIGN PATENT DOCUMENTS

WO 2008/077544 7/2008
WO 2008/077559 7/2008

* cited by examiner

MAT FOR A HYBRID TURF

BACKGROUND

The object of the invention is a mat for a hybrid turf, comprising artificial grass and facilitating growth of natural grass.

Turfs are basically classified as natural turfs and artificial turfs. Natural turfs, wherein grass grows directly on soil, provide high comfort of use, but are prone to damage under heavy use. A damaged natural turf needs long time to recover. Artificial turfs, which consist solely of synthetic material, usually have a form of an artificial mat, from which long blades of artificial grass protrude, wherein the spaces between the blades are filled with artificial granules. Artificial turfs are durable, but provide lower comfort of use as compared to natural turfs.

There are also known hybrid turfs, wherein a base mat with artificial grass is covered by soil, in which natural grass grows. Roots of the natural grass grow through the artificial base and integrate with it permanently. After some time, the natural grass blades grow above the level of the artificial grass blades, providing a comfort of use comparable to that of a natural turf. In the areas of heavy use, for example in the goal area on a soccer field, when the natural grass blades become damaged, the artificial grass blades are uncovered. The comfort of use in these areas is lowered, but not to such an extent as in case of damaged natural turfs.

Mats for hybrid turfs must provide appropriate parameters of the base, including permeability for water and air, they must also enable the natural grass roots to grow through the base. The easiest known way to provide appropriate base permeability is to perforate the base after it is installed on field—this, however, makes the installation of the base relatively complex.

One example of a hybrid turf is known from a US patent application US2007/0248773. It comprises a flexible support having a plurality of holes for allowing the drainage of water through the support. To the flexible support fibres are connected of artificial material in order to form a turf of artificial blades extending from the upper side of the support. The fibres are then kept substantially vertical by granular filling material, which can be made of rubber granules. The turf is therefore completed by living vegetable material put into the granular material by means of sowing, transplantation of portions of plants or a combination thereof. Finally, the living vegetable material in the form of seeds, or of portions of plants, is watered and dressed as known in the art. The turf can be easily carried, rolled up, turned over without spreading the granular material, and laid in a desired moment on a desired support surface for immediate use.

There are known methods for making artificial turf mats by weaving technology. For example, a European patent publication EP2142691 discloses an artificial grass mat comprising a ground fabric and a number of artificial grass blades protruding from the ground fabric, which form pile legs of the artificial grass burls, which are interlaced in the ground fabric over weft yarns in between, according to a W weave structure. The mat comprises at least 20,000 artificial grass burls per $m^2$. Each burl comprises two pile legs, and each artificial grass burl between upright legs is interlaced three, five or seven times over weft yarns in between. At least one of the artificial grass blades protruding from the ground fabric is a monofilament yarn and at least one shrinkable textured yarn. The grass blade-forming pile-warp yarns have a linear mass of less than 5,000 dtex. The pile-warp yarns can be interlaced according to a $\frac{3}{8}$W, $\frac{5}{12}$W or $\frac{7}{16}$W weave structure. The mat is made of polyolefins (polyethylene, polypropylene and blended forms) or polyamides. A mat of this type, supposed to be used as a mat for a 100% artificial turf, is characterized by a relatively high density and is not usable as a hybrid turf mat, because it does not provide adequate space for growth of natural grass. This results from the use of artificial grass blades of relatively low linear mass, below 5,000 dtex, as well as a high number of artificial grass burls—above 20,000 per $m^2$.

SUMMARY

The aim of the invention is to provide a mat for a hybrid turf with a construction alternative to the constructions of the known mats for hybrid turfs.

The object of the present invention is a mat for a hybrid sport or decorative turf, having a form of a woven fabric, with a single-sided cover pile made of olefin synthetic yarns such as polyethylene and/or polypropylene and/or polyester, according to a $\frac{3}{8}$W or $\frac{5}{12}$W or $\frac{7}{16}$W weave structure, comprising pile burls interlaced with weft, wherein the ends of the burls form synthetic grass blades, characterized in that the mat has from 5000 to 20000 pile burls per $m^2$, a warp density from 54 to 72 ends/10 cm, a weft density from 30 to 80 ends/10 cm and a pile height from 20 to 140 mm, wherein each pile burl is interlaced at least two times over three weft fibres, and wherein the total surface mass of the mat is from 753 to 2105 g/$m^2$.

Preferably, the total area of openings in the base fabrics is from 5% to 15% of the total area of the base fabrics of the mat.

Preferably, the weft yarns, the warp yarns and the pile yarns (3, 4) are movable under force of natural grass roots acting on the base fabrics and can extend under this force to a size of at least 25 $mm^2$.

Preferably, the mat comprises at least one opening having an area from 0.5 $mm^2$ to 4 $mm^2$ per each square centimeter of the area of the base fabrics of the mat.

Preferably, the mat further comprises incorporated pile yarn.

Preferably, each yarn of the incorporated pile yarn is located between the working pile yarn and the filling warp.

Preferably, the total linear mass of the working pile yarns is above 5000 dtex.

Preferably, the weft is a polypropylene yarn having linear mass from 280 to 1000 tex and/or a natural fibre yarn having linear mass from 8 Lbs to 29 Lbs or 275.6 to 999.05 tex.

Preferably, the warp is a polyester or polypropylene yarn having linear mass from Nm 20/3 to Nm 20/4 and/or a natural fibre yarn having linear mass from 4/2 Lbs to 8/2 Lbs or 137.8/2 to 275.6/2 tex.

Preferably, the natural fibre yarn is a jute yarn.

Preferably, the bottom of the mat is coated with acrylic or latex glue in the amount from 50 to 120 g/$m^2$ dry mass.

BRIEF DESCRIPTION OF DRAWINGS

The object of the invention is shown on a drawing, in which.

DETAILED DESCRIPTION

Figure 1:
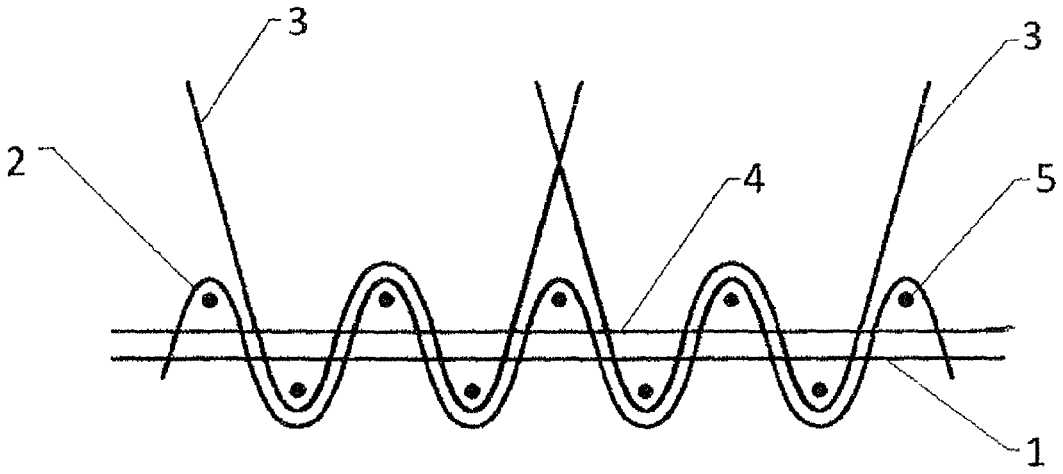
FIG. 1 shows a mat according to the first embodiment, made according to a $\frac{3}{8}$W weave structure.

The mat according to the invention is useful for hybrid sport or decorative turfs, and is formed by a woven fabric made of synthetic and/or natural fibres, comprising an artificial grass cover and a base through which roots of natural grass can easily grow.

The mat has advantages of both artificial and natural turf, it is prone to adverse climatic conditions and can withstand heavy use. If the mat is damaged, only the damaged fragments need to be exchanged. The mat can be used to form turf systems in the final destination or on a plant site. The mat is highly flexible, even with the filling layer with natural grass, therefore it can be rolled up and transported in ready-to-install hybrid turf stripes.

The mat according to the invention is formed by a woven pile fabric made according to a ⅜W or 5/12 or 7/16W weave structure, having from 5,000 to 20,000 burls per $m^2$ and a height of pile forming artificial grass from 20 to 140 mm, wherein each burl is interlaced at least two times over three weft yarns.

The weft can be made of polypropylene yarn having linear mass from 280 to 1000 dtex and/or natural yarns having linear mass from 8 to 29 Lbs or 275.6 to 999.05 tex.

The pile can be made of polyethylene and/or polypropylene yarn having linear mass from 1000 to 12000 dtex.

The warp can be made of polyester or polypropylene yarn having linear mass from Nm 20/3 to Nm 20/4, and/or 4/2 to 8/2 Lbs or 137.8/2 to 275.6/2 tex natural yarns.

The warp density of the mat is from 54 to 72 ends/10 cm, and the total surface mass is from 753 to 2105 $g/m^2$.

The fixation of the burls measured as the value of force necessary to pull out or to break a blade, depending on the weave structure used and its density, ranges from 17 to 74N. The fixation is large enough so that the mat does not need to be additionally coated by glue at the bottom side and maintains maximal elasticity and permeability for water and air. In case there is a need to increase the stability of the mat and resistance of burls to pulling out, the bottom of the mat can be coated with acryl glue, latex glue or polyurethane glue in the amount of 50 to 120 $g/m^2$ dry mass.

Use of 4/2 Lbs jute yarn or 12 Lbs jute yarn as a weft guarantees partial biodegradability of the mat, which further loosens the mat in use and facilitates later growth of natural grass through the mat.

The mat, due to its loose structure, provides good conditions for development of root system of natural grass and permeability for water and air. The warp density from 54 to 72 ends/10 cm and the weft density from 30 to 80 ends/10 cm provides loose structure of the mat with pile linear mass of above 5000 dtex and, at the same time, it allows to obtain openings in the base fabrics of the mat which constitute from 5% to 15% of the total surface area of the base fabrics of the mat. Moreover, in spite of its loose character, the mat maintains a coherent structure even during use.

The coherency of the mat, which is particularly important for heavy use, for example when the mat is used on sport fields, is achieved by use of interlaced arrangement of the binding yarn and the filling yarn between the pile yarn. At least one working yarn which forms the pile is located between interlaced sets of three and six warp threads. Such interlaced configuration of sets of three and six threads provides optimal stability of the weft yarns of the mat, at the same time providing adequate permeability for water and air in the mat, which is at least 100 000 $mmH_2O$/hour. Moreover, the mat according to the invention has a uniform distribution and size of openings in the base, wherein per each square centimeter of the base of the mat, in its initial state, i.e. before it is installed in field, there is at least one opening having an area from 0.5 to 4 $mm^2$. The openings in the mat may scale up when grass roots grow through them, so that the threads surrounding the opening move aside under the force of the grass root, which is possible due to a loose structure of the mat.

In order to further stabilize the mat for a hybrid turf, the mat may comprise incorporated pile yarns, which improve the dimensional stability of the mat. The linear mass of the working pile yarn forming the cover of the mat is from 80% to 120% of the linear mass of the incorporated pile yarn.

Alternatively, yarns of natural fibres in the warp and/or weft configuration may substantially quicken the biodegradability of the mat, and the artificial grass is becoming gradually affixed by the root system of the natural grass.

First Embodiment

FIG. 1

The mat is made as a woven fabric made according to a ⅜W weave structure and is suitable particularly for non-professional recreational objects, in particular in areas with water deficit. The mat comprises: working pile yarns and incorporated pile yarns made of 3×200 tex polyethylene; weft yarns made of 444 tex polypropylene; and binding warp and filling warp yarns made of 4×50 tex polyester. The consumption factors for the yarns are: 1.25 for the incorporated pile; 1.02 for the weft; 1.60 for the binding warp; 1.02 for the filling warp. The weight of the mat is 1191 $g/m^2$. The mat has a weft density of 36 ends/10 cm and the length of yarn in a single burl is 86 mm for a pile height of 35 mm.

Figure 2:
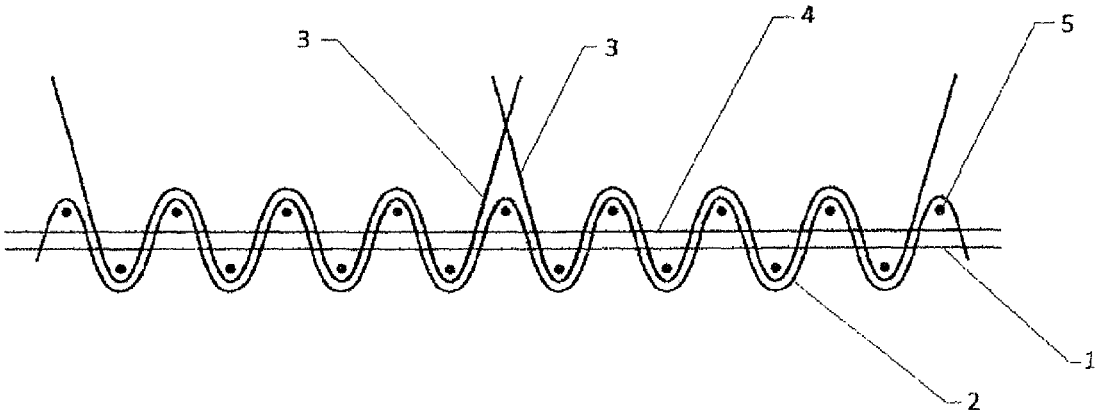
FIG. 2 shows a mat according to the second embodiment, made according to a $\frac{7}{16}$W weave structure.

The mat is made by interlacing the filling warp 1 and the binding warp 2 with the working pile yarn 3, the incorporated pile yarn 4 and the weft 5. The filling warp 1, the binding warp 2, the weft 5 and the incorporated yarn 4 form the base fabrics. The working yarn 3 forms burls of artificial grass, wherein each burl is interlaced three times (as shown in FIG. 1) or seven times (as shown in FIG. 2) with the weft yarns 5 and two ends of the working yarn 3. The mat is made by double face weaving, wherein in a single process two mats are made: a top and a bottom mat, which are then separated by a cuffing device integrated in the weaving machine. In the double face weaving, both fabrics are made of weft yarns 5, binding warp yarns 2, filling warp yarns 1, incorporated yarn 4 and working yarn 3, wherein the working yarns 3 are interlaced interchangeably in the top and the bottom fabric by weft yarns 5 according to a W weave structure, wherein each burl of artificial grass comprises two working yarn ends 3.

Second Embodiment

FIG. 2

The mat is made as a woven fabric made according to a 7/16W weave structure and is suitable for professional soccer fields and other heavy use applications. The mat comprises: working pile yarns and incorporated pile yarns made of 3×200 tex polyethylene; weft yarns made of 444 tex polypropylene; binding warp yarns and filling warp yarns made of 4×50 tex polyester. The consumption factors for the yarns are: 1.25 for the incorporated pile; 1.02 for the weft; 1.60 for the binding warp; 1.02 for the filling warp. The weight of the mat is 1062 g/m$^2$. The mat has a weft density of 36 ends/10 cm and the length of yarn in a single burl is 120 mm for a pile height of 50 mm.

Third Embodiment

FIG. 3

Figure 3:
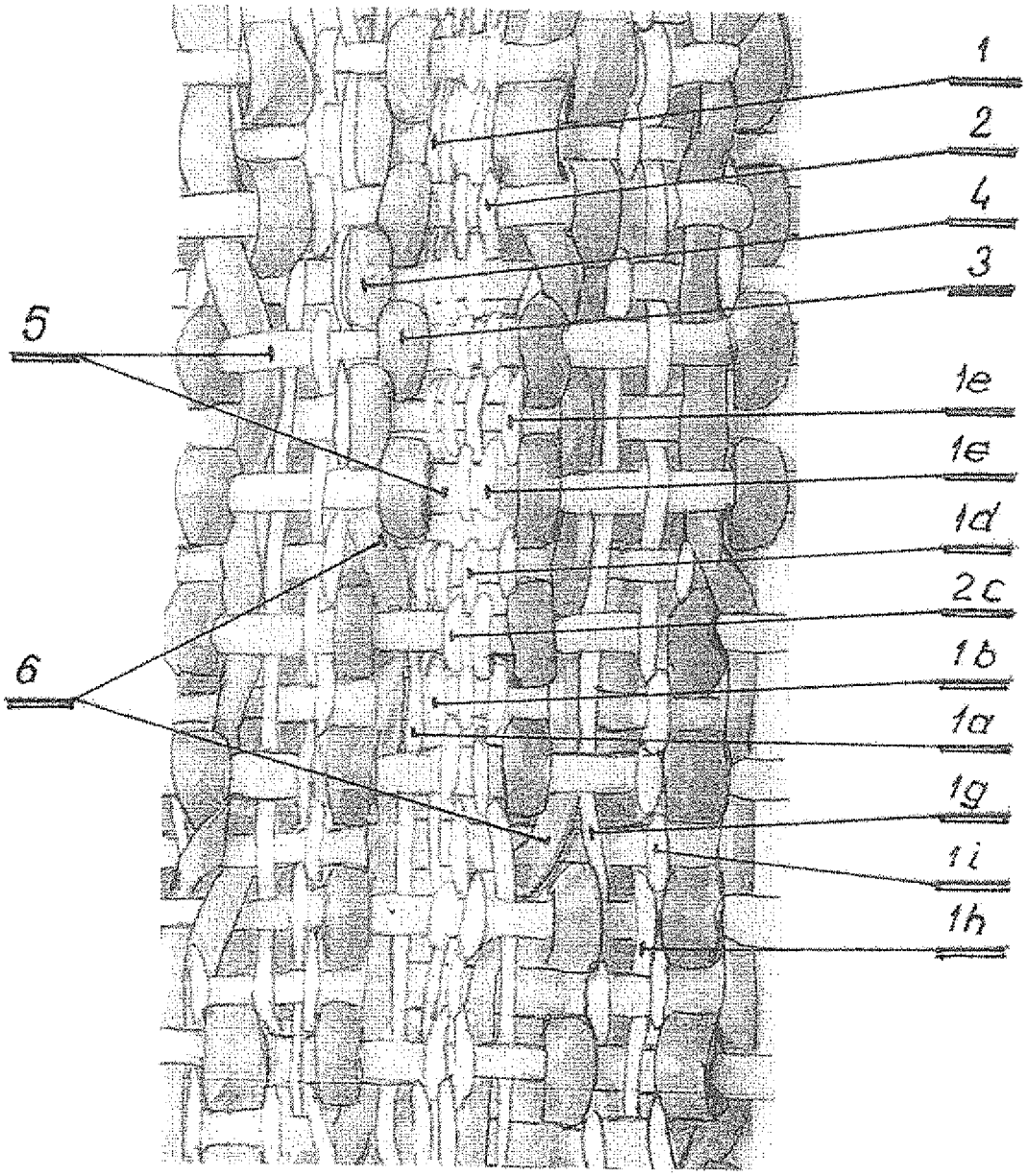
FIG. 3 shows a bottom view of a mat according to the third embodiment, made according to a $\frac{7}{16}$W weave structure.

FIG. 3 shows exemplary distribution of individual threads as viewed from the bottom of the mat, which is made according to a 7/16W weave structure. The mat has a yarn configuration comprising a binding warp 2, a filling warp 1, a working yarn 3 and an incorporated yarn 4—which are interlaced with a weft yarn 5. Each yarn of the incorporated yarn is located between the working yarn 3 and the filling warp 1, wherein the incorporated yarn 5 is interlaced the with weft yarns 5 in the same manner as the yarns of the filling warp 1. The working yarn 3 is interlaced with the weft yarns 5 in the same manner as the binding warp yarns 2. The filling warp yarns 1 and the binding warp yarns 2 form a configuration of interchangeably positioned sets of three and six warp threads, between which, in the warp direction, there are positioned working pile yarns 3 and incorporated pile yarns 4. The set of six warp threads, looking from the left of the figure, comprises consecutively: two filling warp threads 1*a*, 1*b*, a binding warp 2*c*, a filling warp 1*d*, a binding warp 1*e* and a filling warp 1*f*. The set of the six warp yarns provides stability of the mat and keeps the position of the weft yarns 5 along the whole area of the fabric. The set of three warp threads comprises a filling warp 1*g*, a binding warp 2*h* and a filling warp 1*i*. The set of three warp threads allows to obtain a mat having a total pile linear mass of above 5000 dtex while maintaining high permeability for water, air and grass root system.

The mat may further comprise a configuration of two yarns: the working pile yarn 3 and the incorporated pile yarn 4, wherein the incorporated pile yarn 4 is optional. The pile yarns may extend in the warp direction, between the sets of three and six warp threads. The working yarn 3 may be interlaced with weft yarns 5 by a 7/16W weave structure. The ends of the working yarn 3 which extend outside the fabric form artificial grass burls, wherein each burl can be formed by two parallel yarns of the working yarns 3, extending in one row of pile yarns in the warp direction, the ends of which are output from the fabric at the same weft 5 (not shown in the drawing). The burls formed in this way create equal rows in the warp direction, but the burls of a pile in one row are shifted with respect to pile burls of parallel neighbouring rows (i.e. the successive burls of artificial grass do not form parallel rows in the weft direction), which allows obtaining more even distribution of burls on the mat surface.

The incorporated pile yarn may extend between the threads of the working pile yarns 3 and between the sets of six or three warp threads such that each yarn of the incorporated yarn 4, which extends in parallel along one yarn of the working yarn 3 and the set of six weft yarns, in the place 6 of protrusion of two working pile yarns 3, changes its position and extends in parallel between the successive working pile yarn 3 and the set of three warp threads. Such configuration of piles in the fabric provides stability of the dimensions of the mat.

It is preferable to use pile threads having a total linear mass which provides pile linear mass of the mat above 5000 dtex, more preferably above 6000 dtex and most preferably above 10000 dtex. Multicolour polyolefin or polyester yarns can be used as the pile, for example multiple shades of green, which allows obtaining artificial grass buds having shade similar to that of natural grass. For example, the incorporated pile yarn 4 may be formed by three yarns, each having a linear mass of 1000 dtex, and the working pile yarn 3 may be formed by three yarns, each having a linear mass of 1000 dtex, which results in the total pile linear mass of the mat of 6000 dtex.

Use of the incorporated yarn in the base fabrics allowed obtaining a mat having stable dimensions, with adequate parameters such as water and air permeability, and high uniformity of distribution of openings per each square centimeter, which allows use of the mat for creating hybrid sport or decorative turfs.

What is claimed is:

1. A hybrid turf comprising:

a mat with synthetic grass blades; and a filling layer with natural grass growing between the synthetic grass blades of the mat;

wherein the mat comprises a base woven fabric, with a single-sided cover pile made of olefin synthetic yarns, according to a 3/8W or 5/12W or 7/16W weave structure, comprising pile burls interlaced with weft, wherein ends of the burls form the synthetic grass blades;

wherein in a manufactured state the mat has a warp density from 54 to 72 ends/10 cm, a weft density from 30 to 80 ends/10 cm and a pile height from 20 to 140 mm, wherein each pile burl is interlaced at least two times over three weft fibres, wherein the mat has from 5000 to 20000 pile burls per m$^2$, at least one opening having an area from 0.5 mm$^2$ to 4 mm$^2$ per each square centimeter of the area of the base fabrics of the mat, and the total surface mass of the mat is from 753 to 2105 g/m$^2$ and the total area of openings in the base fabrics is from 5% to 15% of the total area of the base fabric of the mat; and wherein in an installed state, in a plurality of portions of the mat the weft yarns, the warp yarns and the pile yarns are moved apart from each other to widen said at least one opening to a size of at least 25 mm$^2$ in the base woven fabric, wherein roots of the natural grass grow in said at least one opening.

2. The hybrid turf according to claim 1, wherein the weft is a polypropylene yarn having linear mass from 280 to 1000 tex and/or a natural fibre yarn having linear mass from 275.6 to 999.05 tex.

3. The hybrid turf according to claim 1, wherein the warp is a polyester or polypropylene yarn having linear mass from Nm 20/3 to Nm 20/4 and/or a natural fibre yarn having linear mass from 137.8/2 to 275.6/2 tex.

4. The hybrid turf according to claim 2, wherein the natural fibre yarn is a jute yarn.

5. The hybrid turf according to claim 3, wherein the natural fibre yarn is a jute yarn.

6. The hybrid turf according to claim 1, wherein the pile further comprises interlaced sets of three and six warp threads and between the interlaced sets of three and six warp threads there is further located an incorporated pile yarn.

7. The hybrid turf according to claim 1, wherein the pile further comprises interlaced sets of three and six warp threads and the set of three warp threads comprises consecutively a filling warp, a binding warp and a filling warp and the set of six warp threads comprises consecutively two filling warp threads, a binding warp, a filling warp, a binding warp and a filling warp.

8. The hybrid turf according to claim 1, characterized in that the burls of a pile in each row are shifted with respect to pile burls of parallel neighbouring rows.

* * * * *